US008292465B2

(12) United States Patent
Horng et al.

(10) Patent No.: US 8,292,465 B2
(45) Date of Patent: Oct. 23, 2012

(54) LAMP

(75) Inventors: Alex Horng, Kaohsiung (TW); Chih-Hao Chung, Kaohsiung (TW); Heng-Yu Hu, Kaohsiung (TW); Ming-Tsung Li, Kaohsiung (TW)

(73) Assignee: Sunonwealth Electronic Machine Industry Co., Ltd., Kaohsiung (TW)

( * ) Notice: Subject to any disclaimer, the term of this patent is extended or adjusted under 35 U.S.C. 154(b) by 0 days.

(21) Appl. No.: 13/316,237

(22) Filed: Dec. 9, 2011

(65) Prior Publication Data

US 2012/0081911 A1 Apr. 5, 2012

Related U.S. Application Data

(62) Division of application No. 12/468,405, filed on May 19, 2009.

(51) Int. Cl.
*F21V 29/00* (2006.01)

(52) U.S. Cl. ..... 362/294; 362/96; 362/249.02; 362/311.02; 362/650

(58) Field of Classification Search ..... 362/96, 362/249.02, 264, 294, 311.02, 373, 650
See application file for complete search history.

(56) References Cited

U.S. PATENT DOCUMENTS 7,144,135 B2 12/2006 Martin et al.
7,244,058 B2 7/2007 Dipenti et al.
7,837,363 B2 11/2010 Liu

*Primary Examiner* — Jason Moon Han
(74) *Attorney, Agent, or Firm* — Muncy, Geissler, Olds & Lowe, PLLC

(57) ABSTRACT

A lamp includes a housing, a heat sink, a light emitter, a fan and a blocking ring. The housing includes first and second shells, with the first shell forming a light-transparent portion and a first engaging portion. An air outlet portion is formed in a wall of the first shell, with the second shell forming a second engaging portion and a base. An air inlet portion is formed in a wall of the second shell. The heat sink includes a base plate and a plurality of fins defining a compartment. Each of the fins has first and second ends. The light emitter is electrically connected to the base. The blocking ring is mounted inside the housing. The blocking ring has two sides forming first and second flanges. The blocking ring further includes a side forming a protrusion ring and partially covering an outer periphery of the heat sink.

4 Claims, 10 Drawing Sheets

LAMP

CROSS REFERENCE TO RELATED APPLICATIONS

This application is a Divisional of co-pending application Ser. No. 12/468,405, filed on May 19, 2009, for which priority is claimed under 35 U.S.C. §120, the entire contents of which are hereby incorporated by reference.

BACKGROUND OF THE INVENTION

1. Field of the Invention

The present invention relates to a lamp and, more particularly, to a lamp providing a self-heat-dissipating function.

2. Description of the Related Art

FIG. 1 shows a conventional lamp device 9 including a housing 91, a light emitter 92, a heat sink 93 and a fan 94. The housing 91 has an end forming a light-transparent portion 911 and another end forming an electrically connected portion 912. The housing 91 has an air inlet portion 913 and an air outlet portion 914 in the wall thereof. The light emitter 92, heat sink 93, and fan 94 are mounted in the housing 91, with the light emitter 92 coupled to the heat sink 93. The heat sink 93 has a side away from the light emitter 92 forming a plurality of fins 931 to define a compartment 932. The fan 94 is mounted in the compartment 932.

In use, the electrically connected portion 912 is coupled to a socket on a wall, a ceiling or a table (not illustrated) for being supplied with electricity so that the light emitter 92 can emit light passing through the light-transparent portion 911 to the environment. Besides, while the light emitter 92 is supplied with electricity generates undesired heat, air is drawn into an interior of the housing from an exterior thereof to form airflow "A" via the air inlet portion 913, passes through the gaps between any two adjacent fins 931, and then is exhausted back to the exterior via the air outlet portion 914. Thereby, through the heat conducting effect of fins 931 of the heat sink 93 cooperating with the movement of the fan 94, the undesired heat is transferred to the environment by the air currents. Consequently, the conventional lamp device provides a heat-dissipating function and, thus, the life of the conventional lamp device is longer than those of lamps without a heat-dissipating function.

Referring again to FIG. 1, although heat-dissipating function for the light emitter 92 can be provided by the heat sink 93 and the fan 94, a part of the airflow "A", designated as "a", easily flows back to the air inlet portion 913 through the gaps between any two adjacent fins 931 after the airflow "A" being drawn into the compartment 932 by the fan 94 through the air inlet portion 913. Accordingly, the undesired heat can't be transmitted to the environment by the airflow "A" through the air outlet portion 914, and the airflow "a" passing through an end of each fin 931 adjacent to the air inlet portion 913 may cause turbulence with airflow "A" newly drawn through the air inlet portion 913. As a result, the heat dissipating efficiency of the heat sink 93 and the fan 94 is reduced and life of the light emitter 92 of the lamp 9 can not be extended effectively.

SUMMARY OF THE INVENTION

It is therefore the primary objective of this invention to provide a lamp device that overcomes the problems of the prior art described above to enhance heat-dissipating efficiency.

The present invention solves the problems in the field of lamp by providing, in a preferred form, a lamp including a housing, a heat sink, a light emitter, a fan and a blocking ring. The housing includes a first shell and a second shell assembled together, with the first shell having an end forming a light-transparent portion and another end forming a first engaging portion. An air outlet portion is formed in a wall of the first shell, with the second shell having an end forming a second engaging portion and another end forming a base. An air inlet portion is formed in a wall of the second shell. The heat sink is mounted inside the housing and includes a base plate and a plurality of fins surrounding the base plate to define a compartment. The fins are close to the air outlet portion of the housing, and each of the fins has a first end facing the air inlet portion of the housing and a second end connecting with the base plate. The light emitter is fixed to the base plate of the heat sink, faces the light-transparent portion of the housing and is electrically connected to the base of the housing. The fan is fixed inside the compartment of the heat sink. The blocking ring is mounted inside the housing and positioned between the air inlet portion and the heat sink, with a center hole of the blocking ring being aligned with the compartment of the heat sink. The blocking ring has two sides respectively forming a first flange and a second flange in an axial direction, with the first engaging portion of the first shell coupling to the first flange and the second engaging portion of the second shell coupling to the second flange. The blocking ring further includes a side forming a protrusion ring extending to the light-transparent portion in an axial direction of the fan and partially covering an outer periphery of the heat sink.

In an example, an inner side of the wall of the second shell forms a plurality of positioning protrusions. The blocking ring has a plurality of apertures around the center hole, and parts of the fins of the heat sink have a plurality of through holes. Each of the through holes extends through one of the fins from the first end to the second end thereof. A plurality of first fixing members extends through the through holes and the apertures. Each first fixing member has an end fixed to each positioning protrusion for the heat sink to be firmly mounted inside the housing.

In another example, the blocking ring is integrally formed on the inner periphery of the housing.

In a further example, a cushion is mounted inside the compartment and the fan is fixed on the cushion.

Further scope of the applicability of the present invention will become apparent from the detailed description given hereinafter. However, it should be understood that the detailed description and specific examples, while indicating preferable embodiments of the invention, are given by way of illustration only, since various will become apparent to those skilled in the art from this detailed description.

BRIEF DESCRIPTION OF THE DRAWINGS

The illustrative embodiments may best be described by reference to the accompanying drawings where.

The present invention will become more fully understood from the detailed description given herein below and the accompanying drawings which are given by way of illustration only, and thus are not limitative of the present invention, and wherein.

Figure 1:
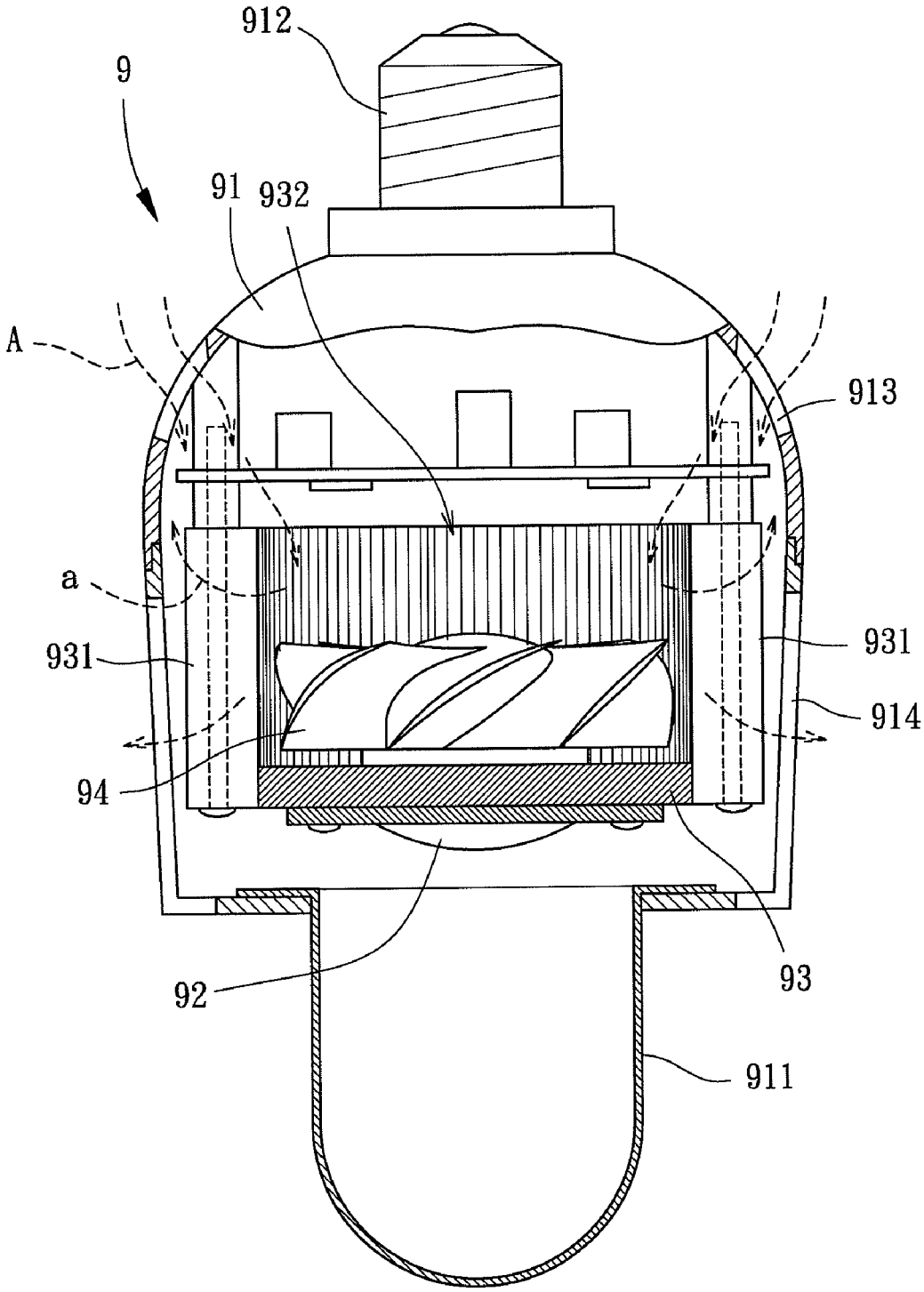
FIG. 1 PRIOR ART
FIG. 1 is a cross sectional view illustrating a conventional lamp.

In the various figures of the drawings, the same numerals designate the same or similar parts. Furthermore, when the terms "first", "second", "axial", "radial" and similar terms are used hereinafter, it should be understood that these terms are reference only to the structure shown in the drawings as it would appear to a person viewing the drawings and are utilized only to facilitate describing the invention.

DETAILED DESCRIPTION OF THE INVENTION

Figure 2:
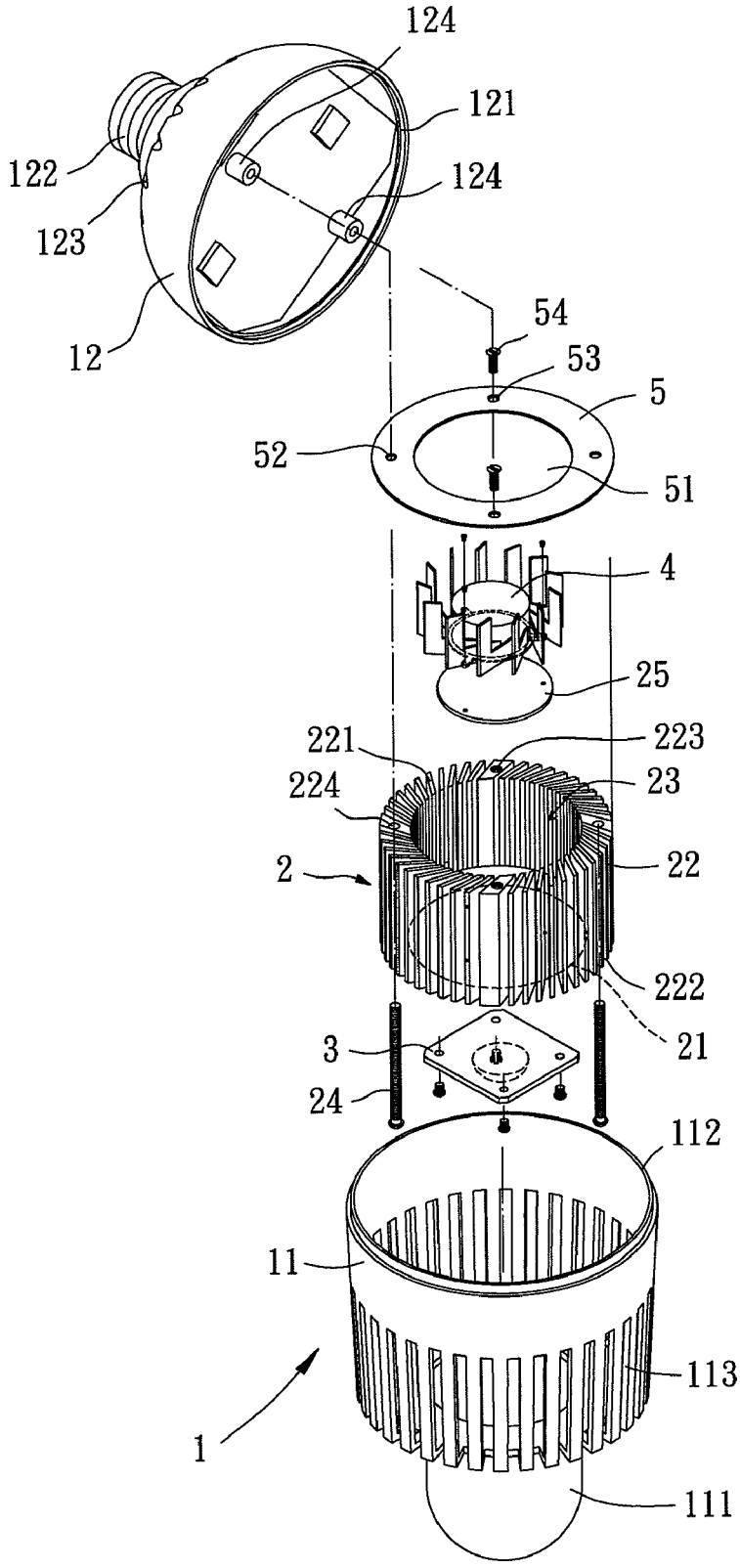
FIG. 2 is an exploded perspective view illustrating a lamp of a first embodiment in accordance with the preferred teachings of the present invention.
Figure 3:
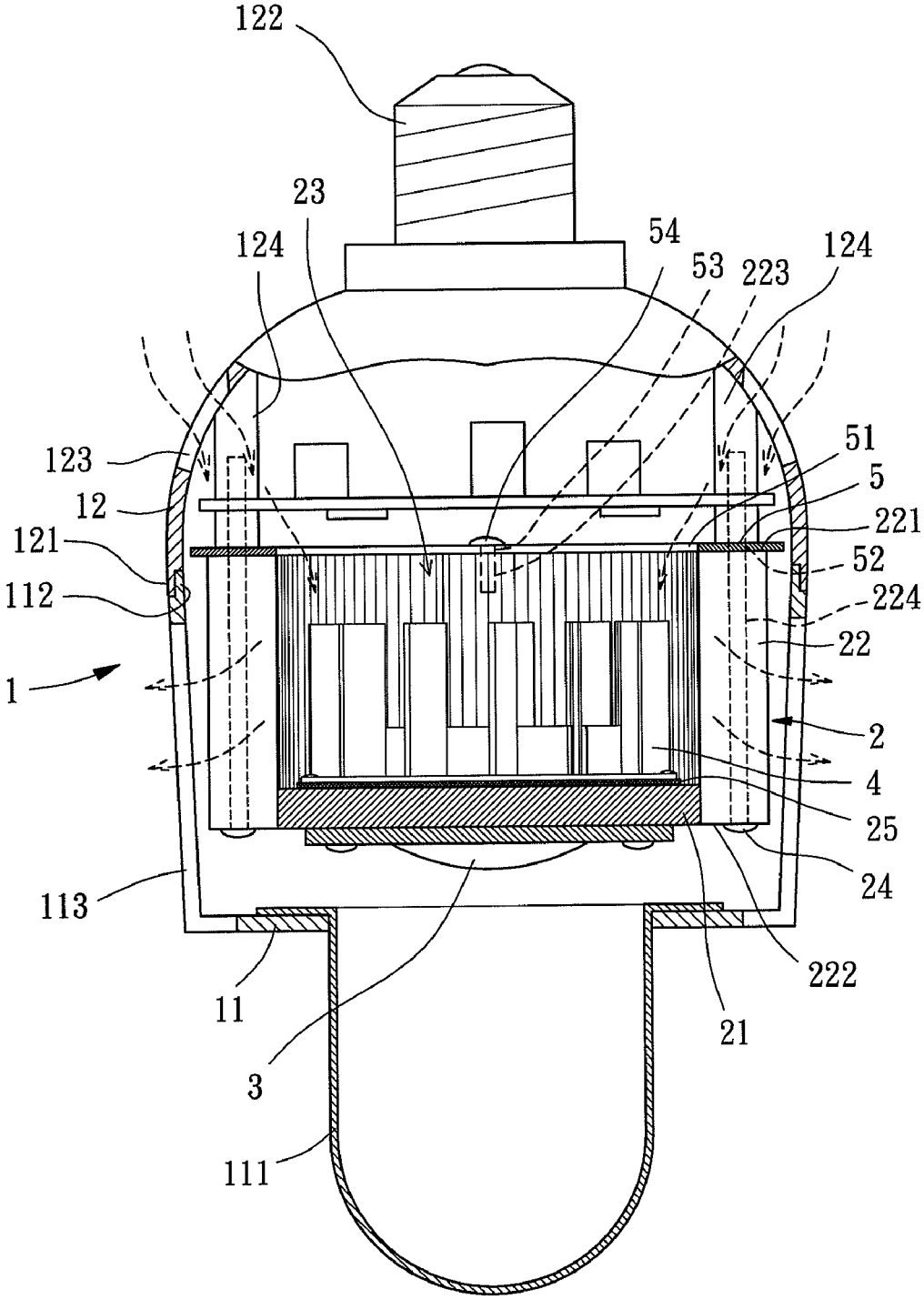
FIG. 3 is a cross sectional view of the lamp of FIG. 2.

A lamp of a first embodiment according to the preferred teachings of the present invention is shown in FIGS. 2 and 3 of the drawings, which includes a housing 1, a heat sink 2, a light emitter 3, a fan 4 and a blocking ring 5.

The housing 1 can be formed with a single piece or two or more assembled pieces to provide a compartment receiving the heat sink 2, the light emitter 3, the fan 4 and the blocking ring 5. In the preferred form shown in FIGS. 2 and 3, the housing 1 includes a first shell 11 and a second shell 12 assembled together. The first shell 11 has an end forming a light-transparent portion 111 and another end forming a first engaging portion 112, with an air outlet portion 113 formed in a wall of the first engaging portion 112. Preferably, the air outlet portion 113 includes a plurality of openings or slots extending through the wall of the first shell 11. The second shell 12 has an end forming a second engaging portion 121 and another end forming a base 122 for electrically connecting with a power source, with an air inlet portion 123 formed in a wall of the second shell 12. Preferably, the air inlet portion 123 includes a plurality of openings or slots extending through the wall of the second shell 12. Furthermore, an inner side of the wall of the second shell 12 forms a plurality of positioning protrusions 124, with the positioning protrusions 124 facing the first shell 11 when the two shells 11, 12 are assembled. With the first engaging portion 112 coupling to the second engaging portion 121, the first shell 11 and second shell 12 can be assembled together into the housing 1.

The heat sink 2 is mounted inside the housing 1 and made of heat conductive materials such as aluminum. The heat sink 2 includes a base plate 21 and a plurality of fins 22 surrounding the base plate 21 to define a compartment 23. The fins 22 are spaced apart with intervals and close to the air outlet portion 113 of the housing 1. Each of the fins 22 has a first end 221 facing the air inlet portion 123 of the housing 1 and a second end 222 connecting with the base plate 21. Parts of the fins 22 of the heat sink 2 have a plurality of positioning holes 223 on the first ends 221. Furthermore, parts of the fins 22, preferably other than those with the positioning holes 223, have a plurality of through holes 224, each of which extends through one of the fins 22 from the first end 221 to the second end 222 thereof. Thereby, a plurality of first fixing members 24 such as screws, bolts or pins extends through the through holes 224, with each first fixing member 24 having an end fixed in an axial hole of each positioning protrusion 124 of the second shell 12, so that the heat sink 2 is firmly mounted inside the housing 1. Besides, there is preferably a cushion 25 mounted inside the compartment 23.

The light emitter 3 is preferably selected from a light-emitting diode (LED), a bulb or any other components that can emit light when supplied with electricity. The light emitter 3 is fixed to the base plate 21 of the heat sink 2 and faces the light-transparent portion 111 of the housing 1. By a plurality of wires (not illustrated), the light emitter 3 is electrically connected to the base 122 of the housing 1.

The fan 4 is fixed inside the compartment 23 of the heat sink 2 and is preferably fixed on the cushion 25. With the cushion 25, vibration produced by the fan 4 is reduced while the fan 4 turns, so that the noise resulted from the vibration is reduced as well.

The blocking ring 5 is mounted inside the housing 1 and positioned between the air inlet portion 123 and the heat sink 2. A center hole 51 of the blocking ring 5 is aligned with the compartment 23 of the heat sink 2. Furthermore, the blocking ring 5 has a plurality of first apertures 52 around the center hole 51 for the first fixing members 24 to extend through, while the blocking ring 5 further has a plurality of second apertures 53 around the center hole 51 for a plurality of second fixing members 54, such as screws, bolts or pins, to extend through. Each second fixing member 54 has an end fixed in each positioning hole 223 of the heat sink 2, so that the blocking ring 5 is fixed to the heat sink 2 close to the first ends 221 of the fins 22. Besides, with reference to FIG. 3, the blocking ring 5 preferably has an outer diameter larger than that of the heat sink 2, so that a gap formed between the inner periphery of the housing 1 and the first end 221 of each fin 22 is reduced.

In use, the base 122 can be coupled to a socket on a wall, a ceiling or a table to supply electricity to the light emitter 3. The light beams emitted from the light emitter 3 transmit through the light-transparent portion 111 to the environment. Moreover, the light-transparent portion 111 can be in various colors so that the lamp device can emit a colored light, e.g. green, yellow or red light. Furthermore, air is drawn by the fan 4 from the environment via the air inlet portion 123, passes through the center hole 51 of the blocking ring 5, further passes through gaps formed between any two adjacent fins 22, and then is exhausted back to the environment via the air outlet portion 113 so as to form airflow. Accordingly, the heat generated by the light emitter 3 can be transmitted to the fins 22 of the heat sink 2 and then be transferred to the environment by the airflow. Therefore, heat-dissipating effect is provided.

Referring again to FIG. 3 with the blocking ring 5, while air is drawn by the fan 4, passes through the air inlet portion 123 and flows into the compartment 23, the blocking ring 5 blocks part of the heated airflow from flowing back to the air inlet portion 123 through the gaps between any two adjacent first ends 221 of the fins 22 and turbulence close to the air inlet portion 123 is avoided effectively. Accordingly, the airflow inside the housing 1 can flow smoothly through the air outlet portion 113 to transfer heat to the environment and heat dissipating efficiency of the heat sink 2 and the fan 4 is enhanced, so that life of the light emitter 3 is extended.

Figure 4:
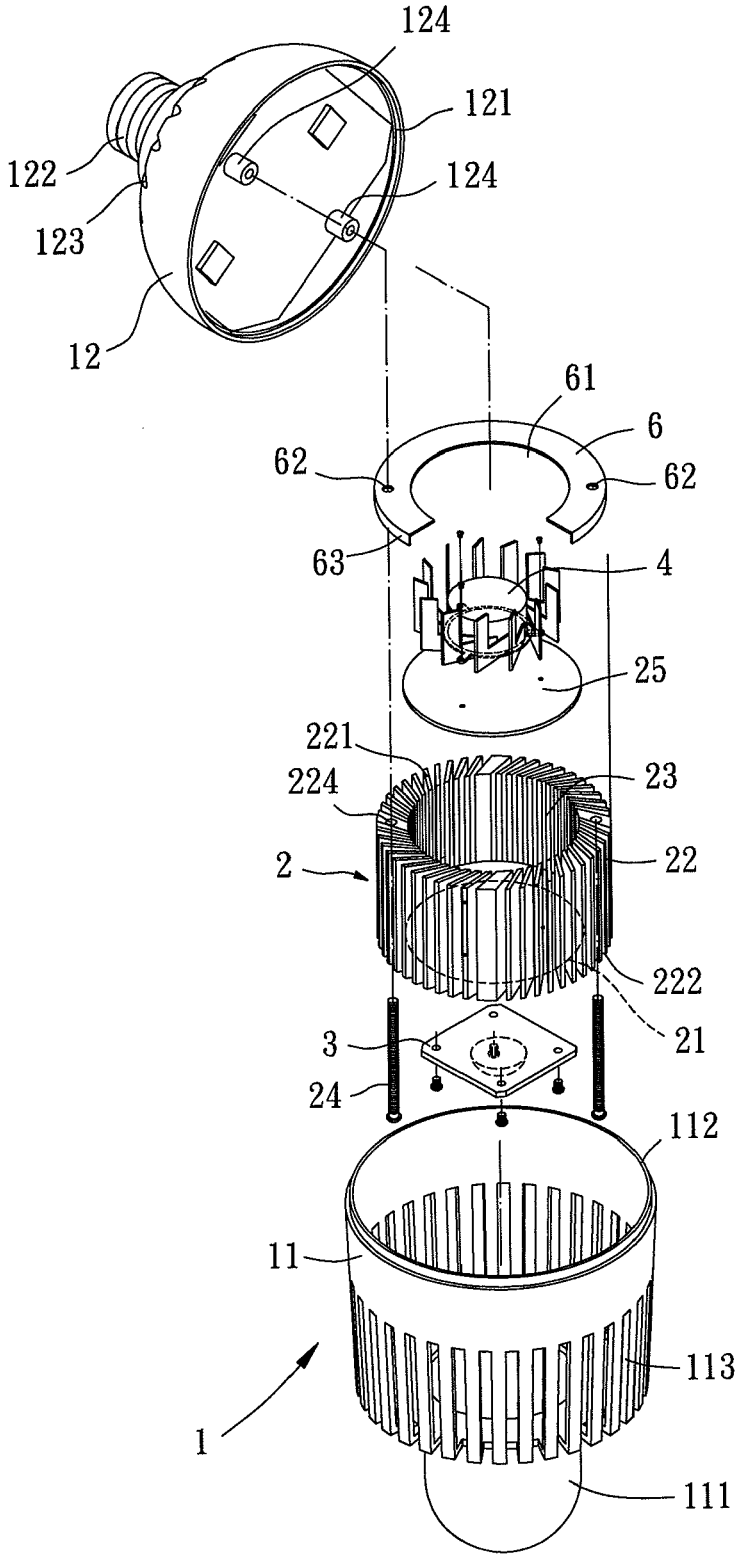
FIG. 4 is an exploded perspective view of a lamp of a second embodiment in accordance with the preferred teachings of the present invention.
Figure 5:
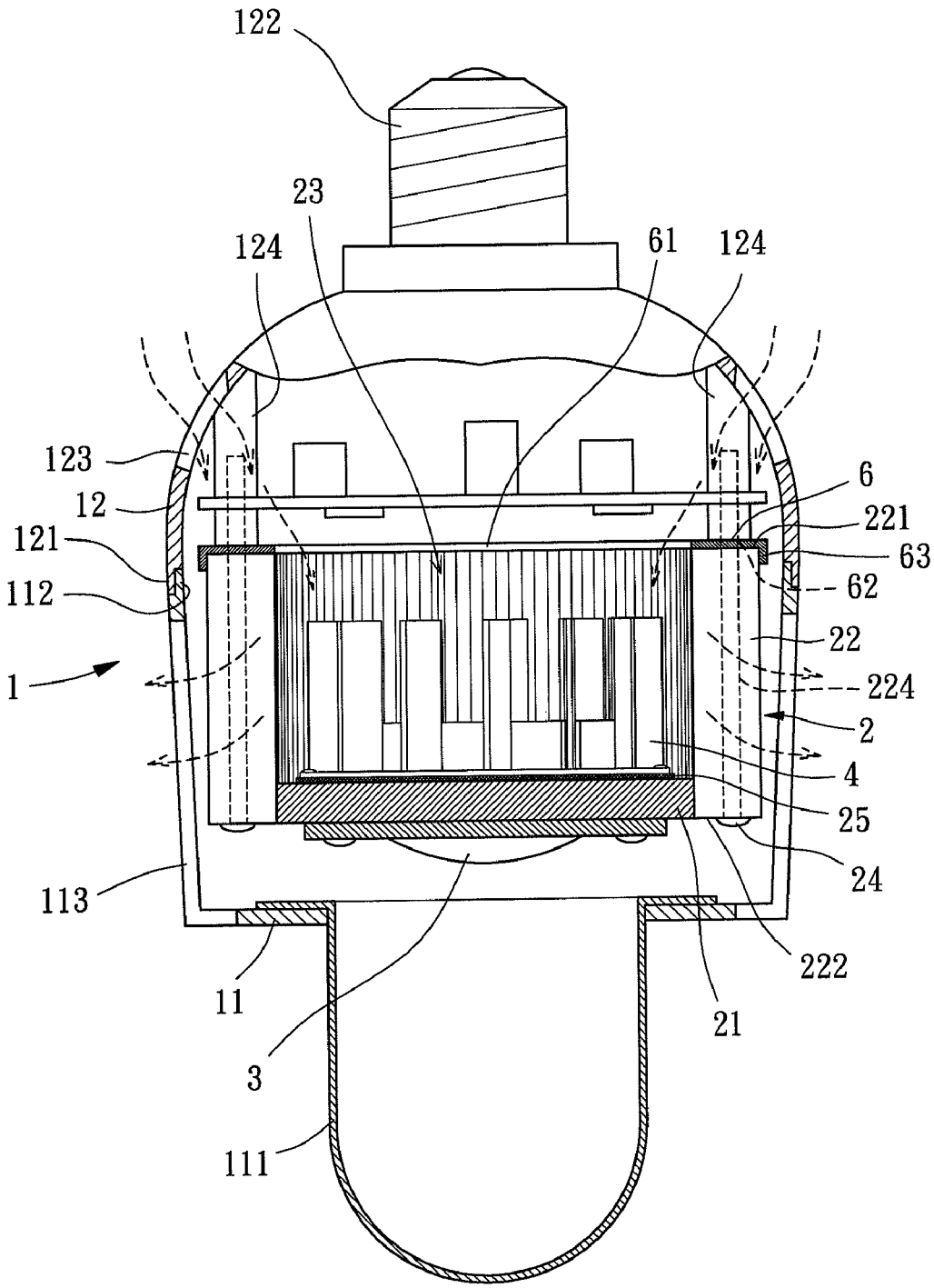
FIG. 5 is a cross sectional view of the lamp of FIG. 4.

FIGS. 4 and 5 show a lamp of a second embodiment according to the preferred teachings of the present invention modified from the first embodiment, which still includes the housing 1, the heat sink 2, the light emitter 3, and the fan 4, but utilizes another blocking ring 6 instead of the blocking ring 5 in the first embodiment and excludes the positioning holes 223 of the heat sink 2. The blocking ring 6 is also mounted inside the housing 1 and positioned between the air inlet portion 123 and the heat sink 2, with a center hole 61 aligned with the compartment 23 of the heat sink 2. The blocking ring 6 has a plurality of apertures 62 around the center hole 61 for the fixing members 24 to extend through. Besides, for the convenient assembly of the blocking ring 6 and the heat sink 2, an outer edge of the blocking ring 6 forms a flange 63 extending in a direction from the first ends 221 to the second ends 222 of the fins 22, so that the flange 63 can fit an outer periphery of the heat sink 2 close to the first ends 221 of fins 22. With the blocking ring 6 of the second embodiment of the present invention, part of the heated airflow can be blocked from flowing back to the air inlet portion 123 through the gaps between any two adjacent first ends 221 of the fins 22. Accordingly, turbulence near the air inlet portion 123 is avoided and heat dissipating efficiency of the heat sink 2 and the fan 4 is enhanced.

Figure 6:
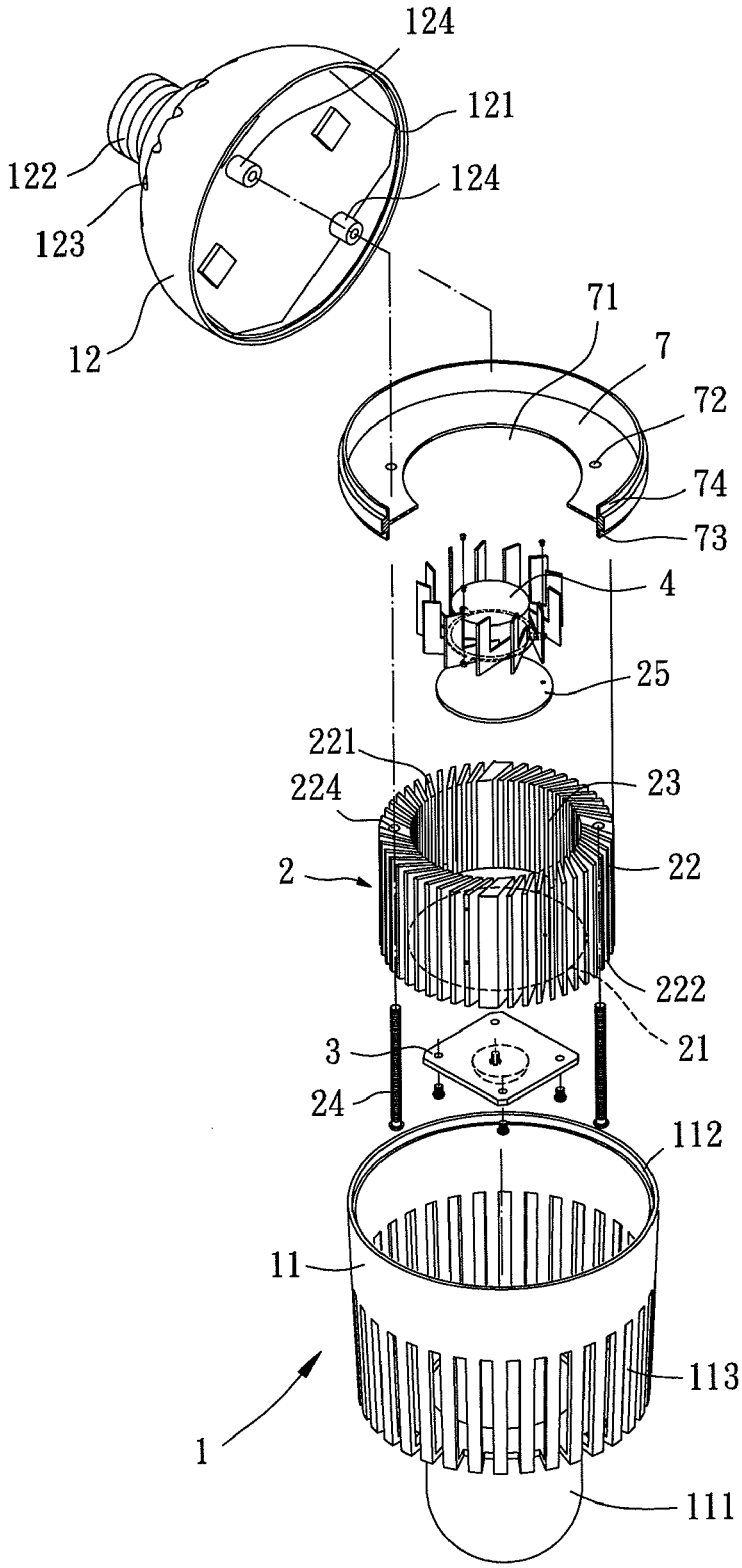
FIG. 6 is an exploded perspective view of a lamp of a third embodiment in accordance with the preferred teachings of the present invention.
Figure 7:
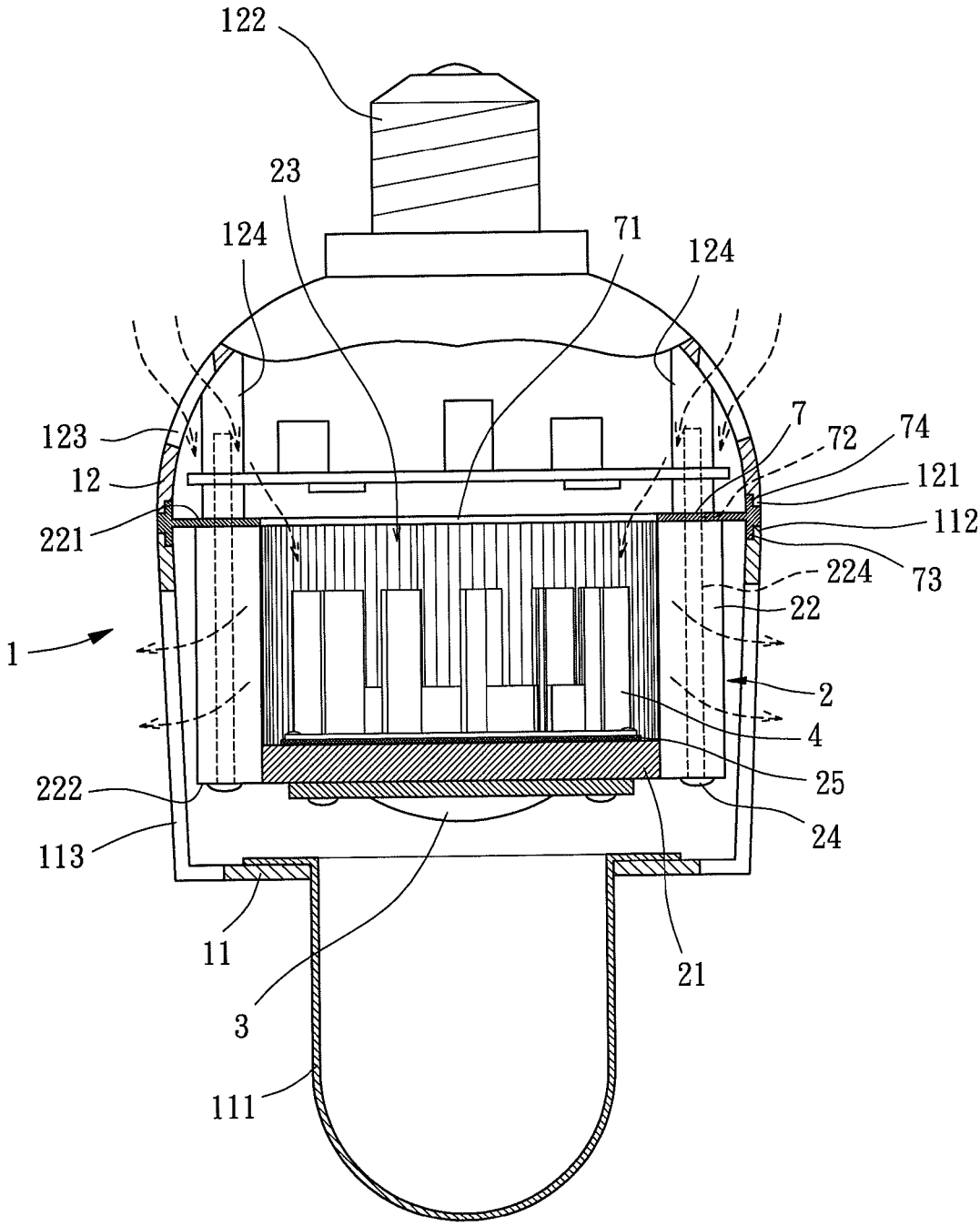
FIG. 7 is a cross sectional view of the lamp of FIG. 6.

FIGS. 6 and 7 show a lamp of a third embodiment according to the preferred teachings of the present invention modified from the first embodiment, which includes the housing 1, the heat sink 2, the light emitter 3, and the fan 4, but utilizes further another blocking ring 7 instead of the blocking ring 5 in the first embodiment and still excludes the positioning holes 223 of the heat sink 2. The blocking ring 7 is also mounted inside the housing 1 and positioned between the air inlet portion 123 and the heat sink 2, with a center hole 71 aligned with the compartment 23 of the heat sink 2. The blocking ring 7 has a plurality of apertures 72 around the center hole 71 for the fixing members 24 to extend through. Preferably, the blocking ring 7 has two sides forming a first flange 73 and a second flange 74 respectively and extending axially from the outer edge thereof. Thereby, the blocking ring 7 can be positioned between the first and second shells 11, 12, with the first engaging portion 112 of the first shell 11 coupling to the first flange 73 of the blocking ring 7, and with the second engaging portion 121 of the second shell 12 coupling to the second flange 74 of the blocking ring 7 by wedging, snapping, screwing and so on. As a whole, the blocking ring 7 is provided for combining the first and second shells 11, 12 together while the blocking ring 7 is sandwiched and fixed between the first and second shells 11, 12, so that the blocking ring 7 and the first and second shells 11, 12 are assembled firmly. As a result, the blocking ring 7 of the third embodiment of the present invention can block part of the heated airflow from flowing back to the air inlet portion 123 through the gaps between any two adjacent first ends 221 of the fins 22, so that turbulence near the air inlet portion 123 is avoided and heat dissipating efficiency of the heat sink 2 and the fan 4 is enhanced.

Figure 8:
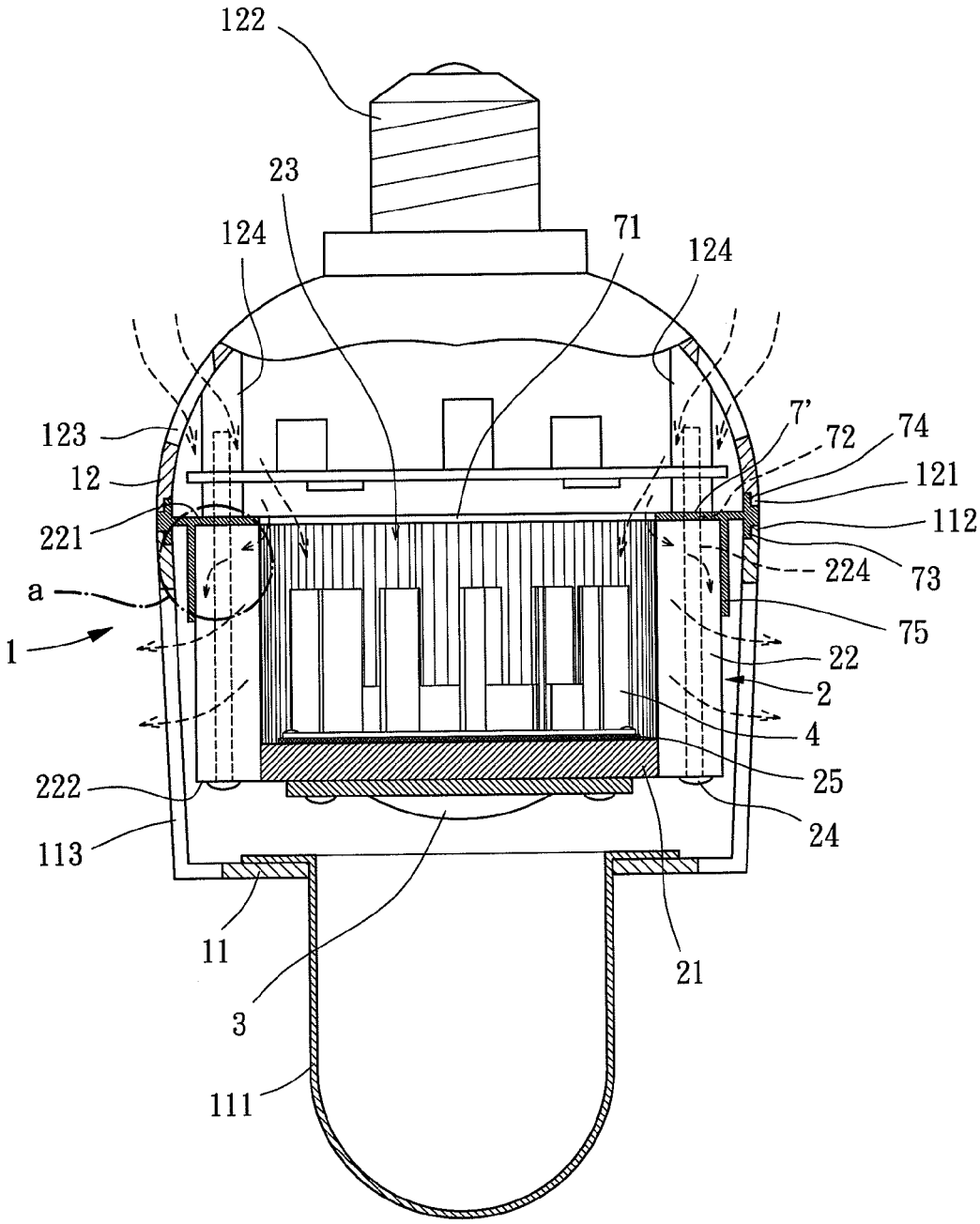
FIG. 8 is a cross sectional view of the lamp of the third embodiment with a protrusion ring.

FIG. 8 show a lamp of the foregoing third embodiment according to the preferred teachings of the present invention; in comparison with the last described lamp, a blocking ring 7' of another preferred form is used instead of the said blocking ring 7. Except for the center hole 71, apertures 72, first flange 73 and second flange 74, the blocking ring 7' further has a side forming a protrusion ring 75 extending to the light-transparent portion 111 in an axial direction of the fan 4. For example, in the axial direction of the fan 4, the protrusion ring 75 preferably extends across an axial level of a side of the fan 4, wherein the said side of the fan 4 faces the center hole 71. Particularly, the protrusion ring 75 covers about half of the outer periphery of the heat sink 2. Hence, the airflow can pass through the gaps of the fins 22 while the protrusion ring 75 surrounds the outer periphery of the heat sink 2 close to the first ends of the fins 22. Accordingly, while air is drawn by the fan 4, passes through the air inlet portion 123 and flows into the compartment 23 through the center hole 71 of the blocking ring 7', the blocking ring 7' blocks part of the airflow from flowing through the gaps between any two adjacent first ends 221 of the fins 22. Also, referring to FIG. 8 in a marked area 'a', the blocking ring 7' prevents the airflow from exiting through the air outlet portion 113 directly until the heat produced by the light emitter 3 and conduced to the fins 22 is fully absorbed by the airflow. Therefore, heat dissipating efficiency of the heat sink 2 and the fan 4 is enhanced, so that life of the light emitter 3 is extended. In addition, the protrusion ring 75 disclosed in the present embodiment can be adapted for the foregoing lamp in the first and second embodiment.

Figure 9:
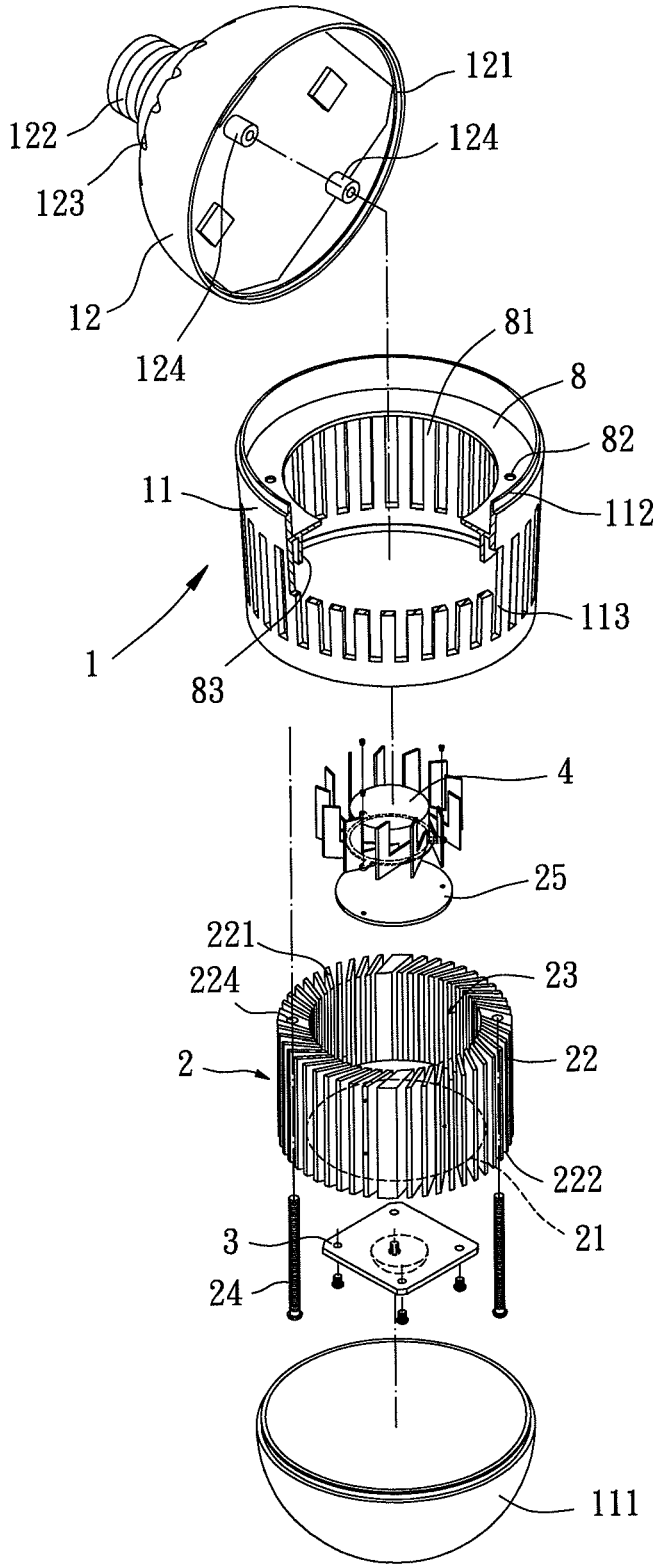
FIG. 9 is an exploded perspective view of a lamp of a fourth embodiment in accordance with the preferred teachings of the present invention.
Figure 10:
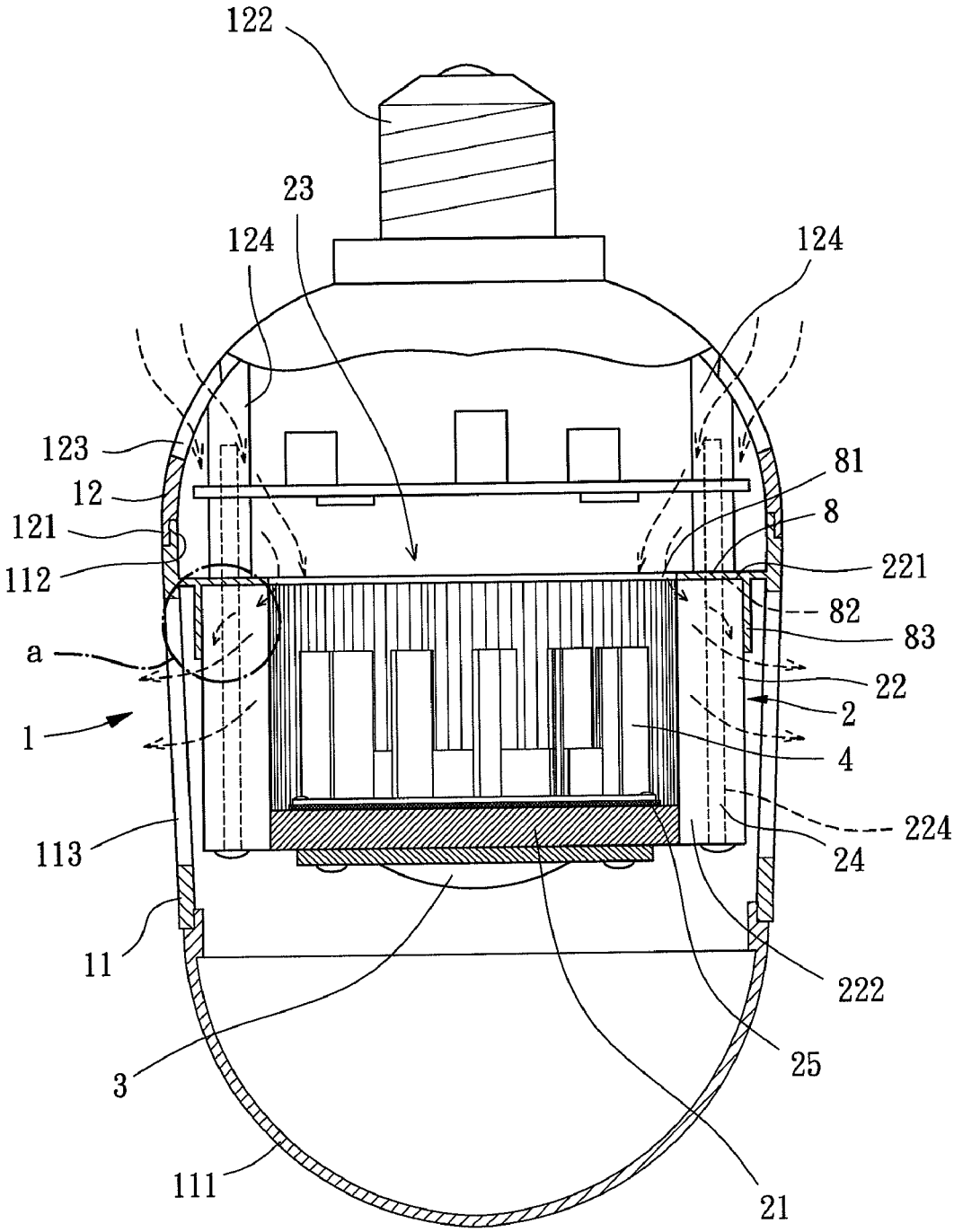
FIG. 10 is a cross sectional view of the lamp of FIG. 9.

FIGS. 9 and 10 shows a lamp of a forth embodiment according to the preferred teachings of the present invention modified from the first embodiment, which still includes the housing 1, the heat sink 2, the light emitter 3 and the fan 4, but utilizes another blocking ring 8 instead of the blocking ring 5 in the first embodiment and excludes the positioning holes 223 of the heat sink 2. The blocking ring 8 is also mounted between the air inlet portion 123 and the heat sink 2, with a center hole 81 aligned with the compartment 23 of the heat sink 2. The blocking ring 8 has a plurality of apertures 82 around the center hole 81 for the fixing members 24 to extend through.

The blocking ring 8 in the fourth embodiment is distinguished from the blocking ring 5,6,7,7' in the foregoing embodiments in that the blocking ring 8 is integrally formed on the inner periphery of the housing 1, that is the housing 1 and the blocking ring 8 are integrated. In the preferred form illustrated in FIGS. 9 and 10, the blocking ring 8 is integrated into the inner periphery of the first shell 11. Accordingly, in comparison with the other lamps of the foregoing first, second, and third embodiments, the lamp of the fourth embodiment is more convenient for assembling. Further, the blocking ring 8 has a side forming a protrusion ring 83, which surrounds the outer periphery of the heat sink 2 close to the first ends of the fins 22. Also, the protrusion 8 prevents the airflow from exiting through the air outlet portion 113 directly until the heat produced by the light emitter 3 and conduced to the fins 22 is fully absorbed by the airflow. Therefore, heat-dissipating efficiency of the heat sink 2 and the fan 4 is enhanced.

As has been discussed above, the lamp of the present invention provides the blocking rings 5, 6, 7,7' and 8, which can block part of the heated airflow from flowing back to the air inlet portion 123, so that turbulence resulting from flowing back airflow is avoided. Consequently, the airflow propelled by the fan 4 can smoothly exit the housing 1 through the air outlet portion 113 to transfer the heat to the environment, and heat-dissipating efficiency of the heat sink 2 and the fan 4 is enhanced, so that the life of the light emitter 3 is extended.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. A lamp, comprising:

a housing including a first shell and a second shell assembled together, with the first shell having an end forming a light-transparent portion and another end forming a first engaging portion, with an air outlet portion formed in a wall of the first shell, with the second shell having an end forming a second engaging portion and another end forming a base, with an air inlet portion formed in a wall of the second shell;

a heat sink mounted inside the housing and including a base plate and a plurality of fins surrounding the base plate to define a compartment, with the fins being close to the air outlet portion of the housing, with each of the fins having a first end facing the air inlet portion of the housing and a second end connecting with the base plate;

a light emitter fixed to the base plate of the heat sink, facing the light-transparent portion of the housing and being electrically connected to the base of the housing;

a fan fixed inside the compartment of the heat sink;

a blocking ring mounted inside the housing and positioned between the air inlet portion and the heat sink, with a center hole of the blocking ring being aligned with the compartment of the heat sink, with the blocking ring having two sides respectively forming a first flange and a second flange in an axial direction, with the first engaging portion of the first shell coupling to the first flange and the second engaging portion of the second shell coupling to the second flange, wherein the blocking ring further has a side forming a protrusion ring extending to the light-transparent portion in an axial direction of the fan and partially covering an outer periphery of the heat sink.

2. The lamp as defined in claim 1, wherein an inner side of the wall of the second shell forms a plurality of positioning protrusions, with the blocking ring having a plurality of apertures around the center hole, and parts of the fins of the heat sink having a plurality of through holes, with each of the through holes extending through one of the fins from the first end to the second end thereof, with a plurality of first fixing members extending through the through holes and the apertures, with each first fixing member having an end fixed to each positioning protrusion for the heat sink to be firmly mounted inside the housing.

3. The lamp as defined in claim 1, wherein the blocking ring integrally formed on the inner periphery of the housing.

4. The lamp as defined in claim 1, wherein there is a cushion mounted inside the compartment and the fan is fixed on the cushion.

* * * * *